United States Patent [19]

Warlick et al.

[11] Patent Number: 4,986,472

[45] Date of Patent: Jan. 22, 1991

[54] HIGH PRESSURE UNIT FUEL INJECTOR WITH TIMING CHAMBER PRESSURE CONTROL

[75] Inventors: Timothy A. Warlick, Columbus; Jeffrey L. Campbell, Hope; Lester L. Peters, Columbus; Michael E. Lucas, Columbus; Julius P. Perr, Columbus; Kuang-Wen T. Wan, Columbus, all of Ind.

[73] Assignee: Cummins Engine Company, Inc., Columbus, Ind.

[21] Appl. No.: 402,893

[22] Filed: Sep. 5, 1989

[51] Int. Cl.[5] ..... F02M 45/00; F02M 53/04

[52] U.S. Cl. ..... 239/88; 239/533.8

[58] Field of Search ..... 239/88–96, 239/124–127, 533.4, 533.5, 533.8

[56] References Cited

U.S. PATENT DOCUMENTS

| | | | |
|---|---|---|---|
| 4,402,456 | 9/1983 | Schneider | 239/91 X |
| 4,410,137 | 10/1988 | Perr | 239/95 |
| 4,410,138 | 10/1988 | Perr | 239/95 |
| 4,441,654 | 4/1984 | Peters | 239/86 |
| 4,471,909 | 9/1984 | Perr | 239/89 |
| 4,721,247 | 1/1988 | Perr | 239/91 |
| 4,903,666 | 2/1990 | Buisson et al. | 123/447 |

*Primary Examiner*—Andres Kashnikow
*Assistant Examiner*—Kevin Weldon
*Attorney, Agent, or Firm*—Sixbey, Friedman, Leedom & Ferguson

[57] ABSTRACT

A fuel injector includes an injector housing having a plunger assembly disposed within a central axial bore and including a lower plunger, an intermediate plunger, and an upper plunger. The lower plunger reciprocates within the central bore to meter a variable quantity of fuel during downward portions of the reciprocating motion. A timing spring is wound around the upper portion of the lower plunger to bias the lower plunger upwardly. A timing chamber formed between the upper and intermediate plungers receives timing fluid to create a hydraulic link between the plungers. Timing fluid exits the timing chamber through a central passage, which may have a reduced area regulating orifice, formed through the intermediate plunger, which is ordinarily closed by a valve mechanism. The valve mechanism is acted upon in part by the timing spring. To improve the pressure regulation using a higher spring load and to accommodate a larger area drainage passage, a valve spring biases closed the passage. The force provided by the valve spring is predetermined to open the valve mechanism and drain timing fluid when the timing fluid pressure exceeds the maximum pressure during injection. After injection is completed, timing fluid exits from the timing chamber either through the central passage or through a spillport which is closable by the nonbeveled lower portion of the upper plunger.

27 Claims, 12 Drawing Sheets

CRANK ANGLE

UPPER PLUNGER TRAVEL
START OF INJECTION
TIMING SPILLPORT OPENS
OUTER BASE CIRCLE

CAMSHAFT VELOCITY
LOW CAM VELOCITY PORTION

UPPER PLUNGER LOAD
LOAD WITH SPILLPORT CLOSURE
LOAD ON STANDARD HPI

INJECTION PRESSURE
SECONDARY INJECTION

HIGH PRESSURE UNIT FUEL INJECTOR WITH TIMING CHAMBER PRESSURE CONTROL

TECHNICAL FIELD

The present invention relates to unit fuel injectors having an open nozzle and a reciprocating injection plunger that is mechanically actuated by an engine cam shaft. More particularly, the present invention relates to a low speed valve, high pressure unit fuel injector in which the timing metering and the timing chamber pressure are independently controlled.

BACKGROUND OF THE INVENTION

The need for improved pollution control and increased fuel economy have caused internal combustion engine designers to seek substantially improved fuel supply systems. In response, unit fuel injectors having a simplified design have been developed to reduce costs, while providing reliable, precise, and independent control over injector timing and metering. The following patents owned by the assignee of the present application disclose such unit injectors, and are representative of the prior art unit injectors upon which the present invention improves: Perr, U.S. Pat. No. 4,471,909; Peters, U.S. Pat. No. 4,441,654; Peters, U.S. Pat. No. 4,410,138; and Perr, U.S. Pat. No. 4,410,137. All of these patents disclose fuel injectors having an open nozzle and a reciprocating injection plunger mechanically actuated by an engine camshaft.

Despite the advancements achieved heretofore, it had not been possible to obtain sufficiently high injection pressure over the entire range of engine speeds. High pressures (on the order of 30,000 psi and above) are desirable in achieving the higher levels of performance and pollution abatement demanded of modern engines. Additionally, the latter two patents disclose hydraulically controlled injection timing using a timing chamber in which a hydraulic link is formed of a variable length dependent upon the pressure of timing fluid supplied to the injector. When the injector reaches the end of its injection stroke, the timing fluid is dumped through a spillport which is constricted (see Perr '137, col. 12, lines 16–30) to insure sufficiently high pressure in the timing chamber to hold the lower injector plunger in its closed position to resist reopening of the injector spray orifices. While these prior patents disclose important advances, none discloses how to maintain the injector orifice closed near the end of timing fluid chamber collapse when the size of the spillport becomes proportionally too large for the decreasing outflow of timing fluid to maintain adequate pressure within the timing fluid.

New legal restrictions on vehicle emissions have created still higher performance requirements for engine manufacturers which must be met in a cost effective and fuel efficient manner not addressed by the injectors disclosed in the above patents. Dealing with the pollutants at the source, in the combustion chamber, requires increasing the efficiency of the combustion process which requires injecting the fuel at considerably higher pressures, particularly during low speed operation. However, in these injectors the clamped high pressure joints limit the injection pressure capabilities of the fuel injector to sac pressures (fuel pressures in the injection chamber upstream of the injector spray holes) under 20,000 psi. Furthermore, because injection commences shortly after a sealing portion of the plunger has blocked the supply port, the seal length of the plunger presents an interface which leaks if high sac pressure levels (over 30,000 psi) occur.

U.S. Pat. No. 4,721,247 to Perr, also owned by the assignee of the present invention, addresses the problems of achieving high sac pressures throughout the entire range of engine speeds. Perr '247 discloses an open nozzle type unit fuel injector capable of achieving sac pressures exceeding 30,000 psi during injection even at low engine speed. This type of injector is known as a high pressure injector (HPI) and includes a plunger assembly having three plungers arranged to form a hydraulic variable timing fluid chamber between the upper and intermediate plungers and an injection chamber below the lower plunger. An increase in sac pressure is obtained under both low and high speed operating conditions by being designed to achieve high pressures at low engine speed and by being provided with a pressure actuated valve for draining timing fluid from the timing chamber when the engine is operated at higher speed.

The '247 patent uses a single spring mounted between the intermediate and lower plunger to bias the intermediate plunger upwardly. By careful design of the spring rate characteristics of the intermediate plunger bias spring, it becomes possible to control the amount of timing fluid which is metered into the timing chamber during each cycle of injector operation by changing the pressure of the timing fluid supplied to the injector. However, in the '247 patent, the intermediate plunger bias spring also supplies the bias force necessary to operate the pressure actuated relief valve. Accordingly, it becomes very difficult to optimize timing fluid metering without affecting adversely the operation of the pressure actuated relief valve and vice versa. Moreover, the size of the drain passage from the timing chamber affects both the opening pressure of the pressure limiting valve and the flow rate of timing fluid drained from the timing chamber, through the pressure limiting valve. Thus, although fuel injectors having relatively simple designs capable of high injection pressure at low operating speed conditions have been developed, there is still a need for an injector that allows independent control over the metering of timing fluid and the opening characteristics of the timing pressure limiting valve, and separate control of the opening pressure of the pressure limiting valve and the flow rate of timing fluid discharge flow.

No known prior art fuel injector incorporates a system for reducing wear, increasing durability, and increasing performance characteristics by means of a variable length hydraulic link forming timing chamber and associated structure whereby the timing fluid metering function can be optimized independently of the pressure limiting valve mechanism which allows high pressure operation of the injector at low engine speed. Similarly, the prior art fails to disclose an end-of-injection spillport mechanism for maintaining the injector orifices closed to eliminate secondary injection.

SUMMARY OF THE INVENTION

It is an object of the present invention to provide a high pressure unit fuel injector having a variable length hydraulic link for controlling injection timing and an injection pressure limiting valve wherein improved pressure regulation is achieved without adversely affecting the metering of timing fluid.

Another object of the present invention is to achieve the above object with a high pressure unit fuel injector using a dual biasing system in conjunction with the valve in which both biasing devices act on the valve to tend to move the valve toward its closed position, thereby regulating the pressure against which timing fluid must act to control the pressure and discharge of the timing fluid, whereas only one biasing device controls the metering of timing fluid.

It is a further object of the present invention to achieve the above objects in which the operation of one biasing device to affect the pressure and discharge of the timing fluid may be optimized without adversely affecting the operation of the other biasing device or the metering of timing fluid.

It is another object of the present invention to achieve the above objects with a high pressure unit fuel injector using a dual biasing system in which the two biasing devices are generally concentric coil springs, and the inner spring acts directly on the valve and the outer spring acts on the valve via a cross pin and spring guide.

Still another object of the present invention is to provide a dual spring high pressure three plunger unit fuel injector in which a valve controls timing chamber fluid drainage during injection to limit peak injection pressures while a separate timing fluid spillport located in the injector housing permits a restricted discharge of timing fluid at the end of injection.

It is yet another object of the present invention to provide a dual spring high pressure three plunger unit fuel injector having a timing chamber spillport separate from the valve drain passage in which operation of the valve and the spillport can be separately optimized, wherein use of the spillport improves performance and durability of the valve and reduces noise levels during idle, low speed operation and low load operation.

It is a further object of the present invention to provide a high pressure unit fuel injector having a timing chamber spillport closure that maintains high spill loads at low speeds and prevents secondary injection.

It is another object of the present invention to provide a high pressure unit fuel injector having a timing chamber spillport closure formed on the upper plunger wherein the upper plunger includes a cylindrical sidewall and a perpendicular, non-beveled lower surface such that the timing chamber spillport is closable by the lower surface passing over the spillport during downward motion of the upper plunger during the downward portion of reciprocating lower plunger movement.

It is another object of the present invention to provide a high pressure unit fuel injector having a timing chamber in which the variable length hydraulic link is formed, having a valve disposed adjacent a timing chamber drain passage which controls the timing chamber pressure, and having increased flow area capabilities in the valve sufficient in some cases to eliminate the need for a spillport in the injector housing.

It is yet another object of the present invention to provide a high pressure unit fuel injector having a pressure relief valve designed with increased flow capabilities without interferring with the opening pressure of the valve when it is acting as a regulator of the timing fluid pressure.

It is a further object of the present invention to provide a high pressure unit fuel injector having a variable length hydraulic link from which timing fluid is drained on a cycle by cycle basis through a timing fluid drain passage by means of a pressure limiting valve and further including a valve seat which defines the opening operating pressure of the valve, and a reduced area portion upstream of the valve seat which controls the rate of discharge flow of the timing fluid to permit a reduced flow than would otherwise be permitted by the valve seat.

It is another object of the present invention to provide a high pressure unit fuel injector wherein the timing fluid drain passage is disposed in the intermediate plunger and has a valve seat with an effective cross-sectional flow area that is at least four percent of the coplanar cross-sectional area of the intermediate plunger.

It is still another object of the present invention to provide a high pressure unit fuel injector in which at rated speed the valve oscillations are reduced and the pressure regulation capabilities are increased to thereby improve the durability of the valve and its biasing spring.

These and other objects are attained by a high pressure unit fuel injector with timing chamber pressure control designed in accordance with the present invention. The fuel injector includes an injector housing having a central axial bore with a plunger assembly disposed within the central bore. The plunger assembly includes upper, lower, and intermediate plungers. A collapsible timing chamber, having a drain passage closable by a valve having a valve element, is formed between the upper and intermediate plungers to receive timing fluid to create a variable length hydraulic link between the upper and intermediate plungers to advance injection timing. The valve element is acted upon in part by the upward bias of a timing spring which tends to move the valve element toward its closed position in addition to establishing a biasing force which resists metering of timing fluid into the timing chamber. However, to improve the pressure regulation using a higher spring load and to accommodate a larger area drain passage, in one embodiment, an additional valve spring acts directly on the valve element to bias the valve element toward its closed position without affecting the metering of timing fluid. The valve opens to drain timing fluid when the timing fluid pressure exceeds the maximum preset pressure governed by the springs at any time during the injection cycle. Also, after the injection stage is completed by the seating of the lower plunger in the injection chamber portion of the central bore, the valve opens to drain the timing fluid. The use of separate timing and valve springs enables the biasing force tending to close the valve to be increased, thereby permitting an increased valve area to be exposed to the valve opening pressure without causing this valve area to operate merely as an orifice. This arrangement also obviates in some embodiments the need for a timing spillport due to the increased flow capabilities.

Additionally, in another embodiment, the intermediate plunger axial passage for draining timing fluid may be formed having a regulating orifice portion, upstream of the valve seat, with a smaller cross-sectional area than the valve seat. This permits a reduced rate of discharge flow than would otherwise be permitted by the valve seat which governs the operating pressure of the valve. This feature may be incorporated into the valve with or without the dual spring feature.

In another alternative embodiment, an independently operating timing fluid spillport is used in addition to the pressure relief valve. The valve regulates and limits peak pressures during the injection stroke at high speed and high load conditions as in the above embodiment, but the spillport controls the collapse of the hydraulic link after the injection stroke. The use of the spillport in combination with the valve in a unit fuel injector improves the pressure regulation and performance capabilities of the valve and improves the durability of the valve by reducing the use of the valve at the end of injection. This feature can also be combined with the valve modifications discussed above. Additionally, according to the present invention, in any high pressure unit fuel injector embodiment incorporating a timing chamber spillport, the lower edges of the upper plunger portion of the plunger assembly may be formed with straight, nonbeveled edges created by the cylindrical sidewall of the upper plunger intersecting at a perpendicular angle the lower planar surface of the plunger. The cylindrical sidewall passes over the spillport to gradually close the spillport to maintain high spill loads at low speeds and prevent secondary injection.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

BRIEF DESCRIPTION OF THE DRAWINGS

FIGS. 15*a*, 15*b*, 15*c*, and 15*d* are graphs of the performance of the high pressure unit fuel injector of FIG. 13 illustrating the upper plunger travel, camshaft velocity, upper plunger load, and injection pressure versus crank angle.

DETAILED DESCRIPTION OF PREFERRED EMBODIMENTS

Referring to the figures, a high pressure unit fuel injector having a pressure limiting valve according to the present invention is shown. The unit fuel injector is of the open nozzle type as shown in commonly assigned U.S. Pat. No. 4,721,247 to Perr and is part of a fuel injection system wherein each injector is driven by a rotating camshaft via a conventional drive train assembly (not shown), in which a cam is mounted on a rotatable camshaft and a cam follower rides on the cam to cause the injector plunger to reciprocate in synchronism with camshaft rotation.

Attempts by the inventors named herein to improve upon the valve devices of prior art fuel injectors by simply using larger timing fluid flow holes resulted in the determination that the larger total hole area serves as a restriction that causes the valve to act as an orifice rather than a regulator. As the total hole size is increased, the valve operating pressure decreases. The spring load cannot be increased sufficiently to prevent this opening pressure decrease because the valve spring also serves as the timing metering spring, and increasing this force would adversely affect the metering of timing fluid into the timing chamber.

Figure 1:
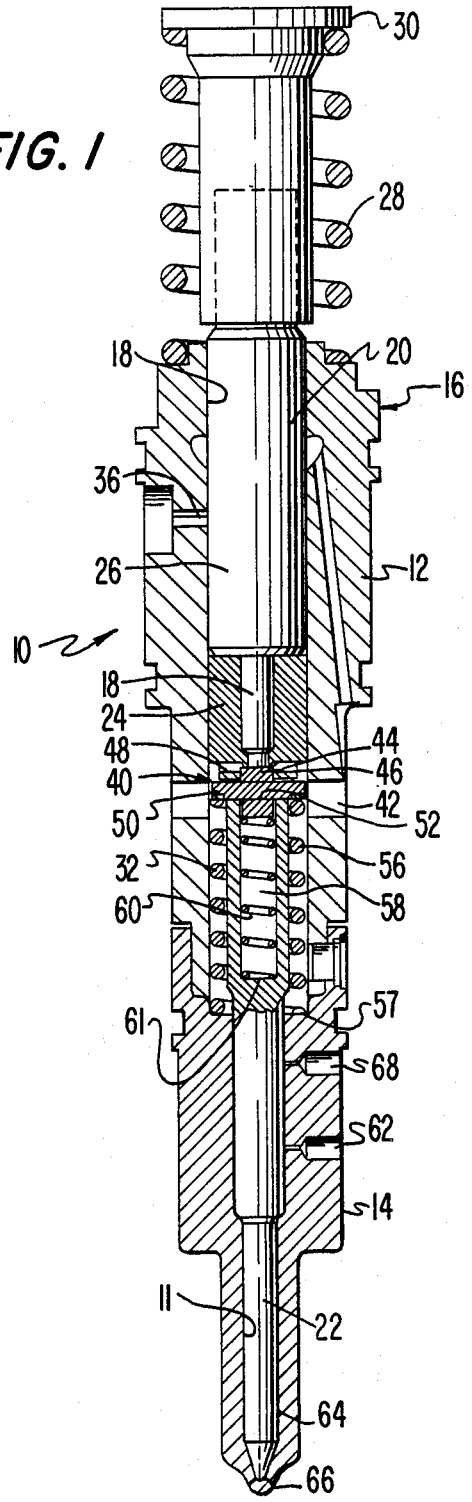
FIG. 1 is a cross-sectional view of a dual spring high pressure unit fuel injector according to one embodiment of the present invention.

To overcome the problems noted above, the inventors developed an open nozzle unit fuel injector illustrated in FIG. 1 incorporating a dual spring low speed valve. The fuel injector of FIG. 1 is adapted to be used in an injection system including one cam driven unit injector per cylinder and a fuel pump which supplies all the injectors by a common rail or supply line. The fuel injection system requires three common fluid rails (not illustrated) within the cylinder head to communicate with each fuel injector. One rail supplies fuel to each injector for metering into the injection chamber, a second rail drains away fuel that is not injected, and a third supplies timing fluid (which may also be fuel) to vary the timing of the injection event. These functions are described in greater detail in commonly assigned U.S. Pat. No. 4,721,247. By varying the timing fluid pressure in the third rail, the effective length of the plunger is caused to increase and advance the beginning of injection, or to decrease and retard the beginning of injection. The fuel pump and engine throttle operate to supply fuel at a variable rail pressure in the first rail, which controls the quantity of fuel injected. The rail pressure may be varied in accordance with pressure/time (PT) metering principles and the timing pressure may be varied in accordance with pressure metering principles as further described in the '247 patent noted above.

In particular, FIG. 1 shows a fuel injector 10 which is intended to be received within a recess contained in the head of an internal combustion engine (not shown). The fuel injector injects a variable quantity of fuel that is metered into the injection chamber 11 (shown collapsed) into the combustion chamber of the engine. The body or housing 16 of the fuel injector is formed of two sections, an injector barrel 12 and a one-piece injector cup 14. Extending axially through the fuel injector is a bore 18 within which a reciprocating plunger assembly 20 is disposed for injecting fuel into the combustion chamber of the internal combustion engine. The plunger assembly is shown in its fully advanced position.

The reciprocating plunger assembly 20 includes three plungers. An injection or lower plunger 22 is the lowermost plunger as shown in FIG. 1 and injects fuel into the combustion chamber of an engine as discussed below. Serially arranged above lower plunger 22 are an intermediate plunger 24 and an upper plunger 26. A compensating chamber 32 is formed below intermediate plunger 24 and surrounds the upper end of injection plunger 22. A plunger assembly return spring 28 engages the upper end 20 of upper plunger 26 at one end and seats against the top of the injector barrel 12. Return spring 28 biases the upper plunger 26 to return it to an uppermost position within bore 18 as allowed by the injection cam which acts thereon via the drive train assembly.

Between upper plunger 26 and intermediate plunger 24 a collapsible timing chamber 34 is formed. Timing chamber 34 receives hydraulic timing fluid, such as fuel, from a timing fluid passageway 36 formed through the barrel portion 12 of injector housing 16. As described below, timing fluid disposed in timing chamber 34 forms a hydraulic link between intermediate plunger 24 and upper plunger 26, and is discharged therefrom under certain conditions through timing chamber drain passage 38 preferably formed centrally axially through intermediate plunger 24. The bottom of timing chamber drain passage 38 opens into compensating chamber 32 and is closed by valve mechanism 40 which is sandwiched between the lower end of intermediate plunger 24 and the upper end of lower plunger 22 disposed within compensating chamber 32. When valve mechanism 40 opens, timing fluid drains from timing chamber 34, through drain passage 38, into compensating chamber 32, and out of the injector through drainage passageway 42. Drainage passageway 42 also may be used for scavenge flow as described below. Valve mechanism 40 controls the pressure of the timing fluid in timing chamber 34, which, in turn, controls the timing of fuel injection as well as the upper limit of injection pressure of the injected fuel.

Figure 2A:
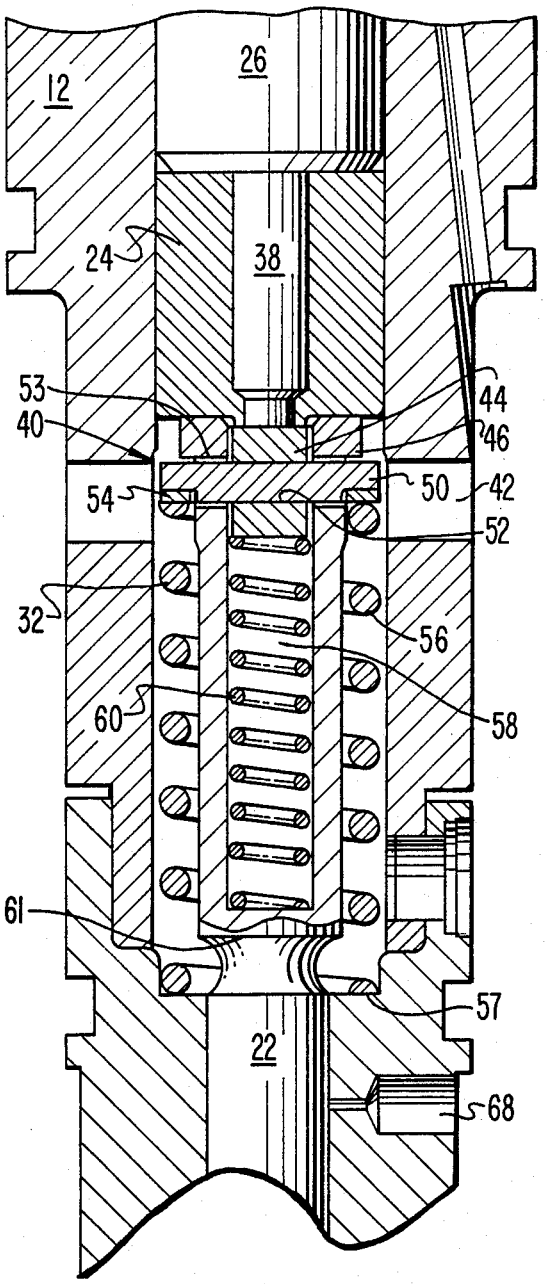
FIG. 2*a* is an enlarged cross-sectional view of the valve mechanism of the fuel injector of FIG. 1.
Figure 2B:
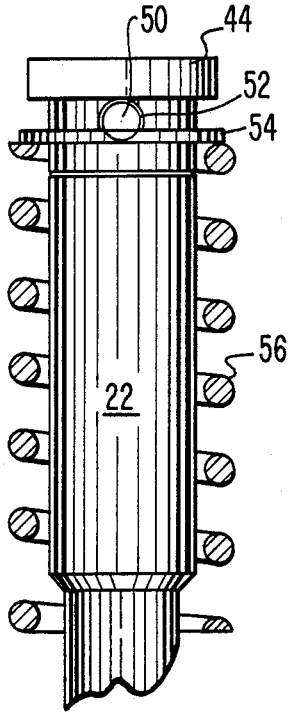
FIG. 2*b* is a broken away side view of the valve mechanism of FIG. 2*a*.

Valve mechanism 40, as better illustrated in FIGS. 2-4, includes a valve element 44 reciprocally slidable within a valve guide 46, which is an upper portion of lower plunger 22 and has a fluid flow passage 48 (FIG. 3) formed therein. An actuating member such as a cross pin 50 is disposed through a bore 52 in valve body 44 and extends radially outwardly from valve element 44 across most of the width of compensating chamber 32. Alternatively, cross pin 50 may be integrally formed with valve element 44. Cross pin 50 is received without clearance in bore 52 and is disposed, with clearance, through a radial bore 53 formed in lower plunger 22. This bore forms the lower portion of the valve guide 46. Spring guide 54 is disposed beneath the outermost portion of cross pin 50 and around lower plunger 22.

Valve mechanism 40 has improved pressure regulation capabilities and improved durability, which goals are accomplished to various degrees by different aspects of this invention. In the first aspect, two separate and independent springs are used as follows. A timing spring 56, which preferably is a coil spring, is positioned within compensating chamber 32 around lower plunger 22. The upper end of timing spring 56 acts against valve mechanism 40 by engaging the outer end of cross pin 50 preferably through the spring guide 54. The lower end of timing spring 56 rests on a seat 57 formed in the bottom of compensating chamber 32. Thus, the force of timing spring 56 serves to draw lower plunger 22 upwardly into engagement with intermediate plunger 24 to force the three plungers, lower plunger 22, intermediate plunger 24, and upper plunger 26, together after completion of an injection cycle until metering and timing has commenced for the next cycle. This establishes a biasing force which resists the metering of timing fluid into the timing chamber to vary the advancement of injection timing in a known manner. Additionally, because the timing spring 56 acts on the valve mechanism 40, it also tends to move the valve mechanism upwardly toward its closed position. The upper portion of lower plunger 22 that resides predominantly within compensating chamber 32 includes a hollow bore 58 and contains a valve spring 60 which also is preferably a coil spring. The lower end of valve spring 60 is seated at the bottom 61 of the hollow bore 58. The upper end of valve spring 60 acts directly against the lower surface of valve element 44. Thus, the force of valve spring 60 acts between lower plunger 22 and valve element 44, and valve spring 60 supplements the force of timing spring 56 against valve mechanism 40 to bias the valve mechanism toward its closed position. The use of a second, separate valve spring 60 allows the valve opening pressure to be increased without placing additional unnecessary loads on timing spring 56 which also is required, as discussed above, to bias lower plunger 22 upwardly. This is accomplished in the following manner. Both timing spring 56 and valve spring 60 provide an upward force on the the valve element 44 to maintain the valve in a closed position until the timing fluid pressure exceeds the combined pressure caused by the two springs. Thus, increasing the spring force of valve spring 60 increases the valve opening pressure. However, such an increase does not affect the force tending to resist the metering of timing fluid into the timing chamber which are governed by the timing spring 56. This is accomplished because the valve spring 60 does not provide a force on the lower plunger 22 relative the injector housing 16 and because the freedom of upward movement of valve element 44 relative to lower plunger 22 is quite limited as discussed below. Pressure regulation is improved using a higher spring force supplied by valve spring 60, and a larger valve area may be used to prevent the valve from operating as an orifice rather than as a timing fluid pressure regulator.

Figure 3A:
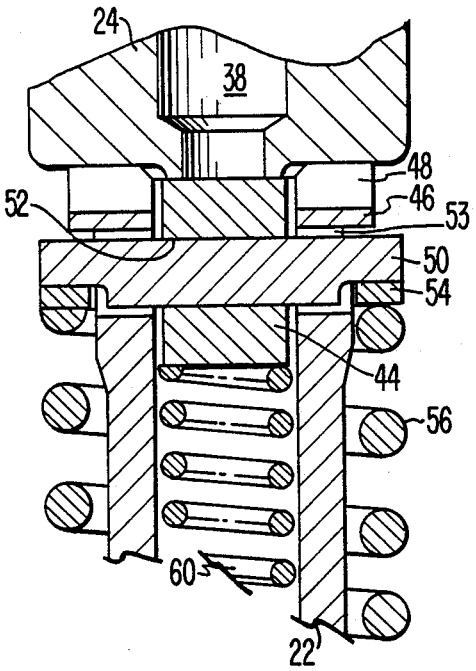
FIGS. 3*a* and 3*b* are enlarged broken away cross-sectional views of the valve mechanism employed in the injector of FIGS. 1, 2*a*, and 2*b* wherein the valve mechanism is illustrated in the closed and open positions, respectively.
Figure 3B:
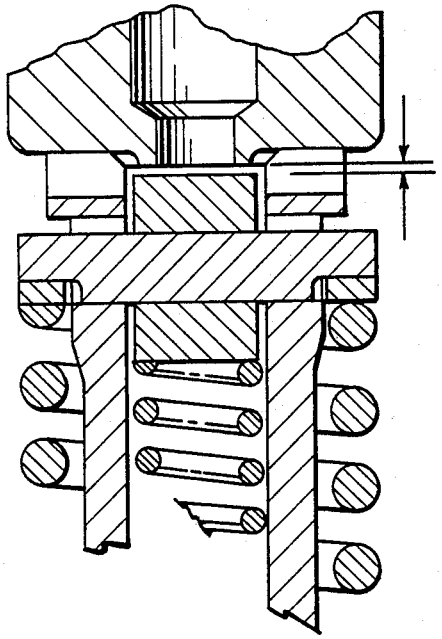
Figure 4A:
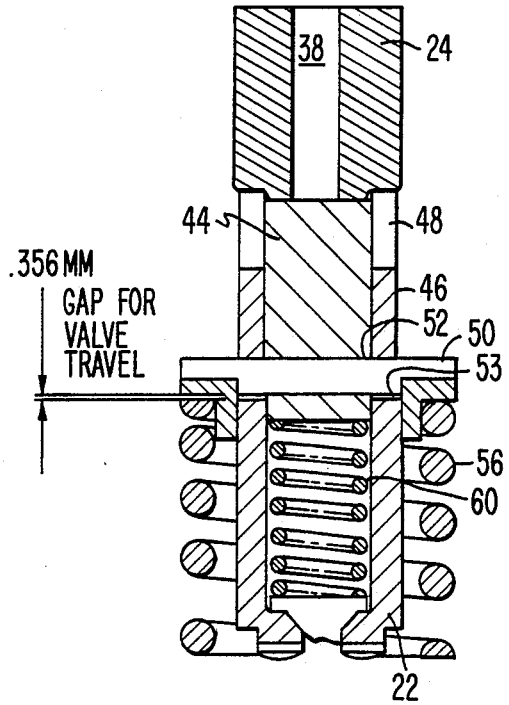
FIGS. 4*a* and 4*b* are views similar to FIGS. 3*a* and 3*b* showing another embodiment of the valve mechanism.

Furthermore, once the valve mechanism 40 has been moved to its closed position to completely seal the timing chamber drain passage 38, any additional biasing force supplied by the valve spring 60 is ineffective to cause additional relative movement. This motion limiting feature is best illustrated in FIGS. 3 and 4 and is accomplished by limiting the diameter of the radial bore 53 through the lower plunger 22 with a height equal to the thickness of the cross pin 50 passing therethrough plus the desired valve opening distance. When the valve element 44 of the valve abuts against the intermediate plunger 24 to close the timing chamber drain passage, as shown in FIGS. 3*a* and 4*a*, the cross pin abuts against the upper surface of the lower plunger radial bore 53. Any further upward expansion of the valve spring 60 or further upward movement of the valve element 44 or the cross pin 50 is prohibited. Thus, in this position, the ends of the valve spring are pushing against spaced portions of the lower plunger which is not formed of separate components relatively movable. The valve spring cannot move any of the components of the plunger assembly or valve mechanism and, therefore, the valve spring does not impair or affect the performance of the timing spring.

Figure 5A:
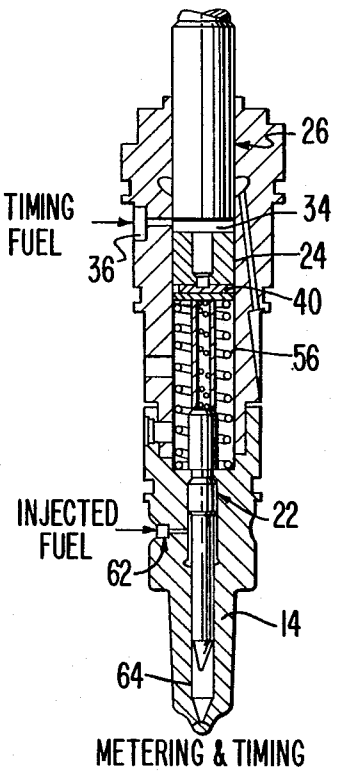
FIGS. 5*a*–5*d* are cross-sectional views of the fuel injector of FIG. 1 in the different phases of its operation.

The operation of fuel injector 10 is as follows as illustrated in FIG. 5, and the first of the four stages of each injection cycle is shown in FIG. 5*a* which illustrates the metering and timing stage. Upper plunger 26 has been retracted sufficiently by return spring 28 to uncover timing fluid passageway 36 so that timing fluid enters through the timing fluid passageway into timing chamber 34 and exerts a pressure that separates intermediate plunger 24 from upper plunger 26 by causing timing spring 56 to compress. The amount of separation of upper plunger 26 from intermediate plunger 24 is determined by the equilibrium between the spring force of timing spring 56 and the force produced by the timing fluid pressure acting on the area of intermediate plunger 24. The greater the separation between plungers 24 and 26, the greater the advance of injection timing.

Spring 56 also moves plunger 22 upwardly a sufficient extent for fuel to pass into injection chamber 64 adjacent the injection nozzle 66 having a plurality of orifices disposed at the bottom of injection chamber 64. This spring also establishes a biasing force which resists the metering of timing fluid into the timing chamber 34. Then, at the same time that the injection timing is being established by the feeding of timing fluid into timing chamber 34, fuel for injection is caused to flow through a feed orifice of fuel supply passage 62 into the upper portion of injector cup 14. During metering of injection fuel, injection chamber 64 will be partially filled with a precisely metered quantity of fuel in accordance with known pressure/time principles whereby the amount of fuel metered is a function of the supply pressure and the total metering time that fuel flows through fuel supply passage 62, which has carefully controlled hydraulic characteristics in order to produce the desired pressure/time metering capability.

Figure 5B:
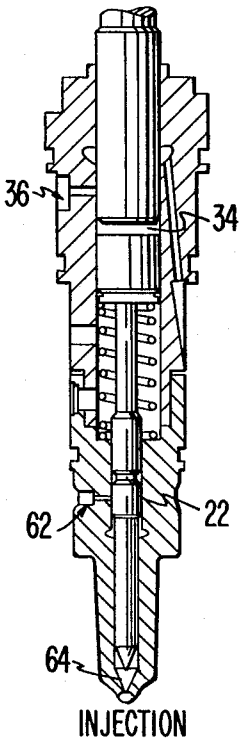

In the second stage shown in FIG. 5*b*, cam rotation causes upper plunger 26 to be driven downwardly via the drive train assembly. As a result, timing fluid is forced back out through timing fluid passageway 36 until the passageway is closed by the leading edge of upper plunger 26. The leading or lower edge of upper plunger 26 may be beveled as is conventional, or it may be straight, forming a right angle with its lower edge to improve closure of a spillport, where used, as described below. At this point, the timing fluid becomes trapped between plungers 24 and 26 to form a hydraulic link which causes all three plunger elements to move in unison toward the nozzle tip at the bottom of injection chamber 64. If, during the downward movement of plunger assembly 20 the timing fluid pressure exceeds the maximum preset pressure as determined by the combined force of valve spring 60 and timing spring 56, valve mechanism 40 opens to drain timing fluid from timing chamber 34 through timing chamber drain passage 38 and drainage passageway 42 to reduce the pressure to within the preset limits. Regardless, as shown in FIG. 5*b*, plunger 22 closes fuel supply passage 62 as it moves downwardly to terminate fuel metering. However, the fuel metered into injection chamber 64 does not begin to be pressurized until plunger 22 has moved into injection chamber 64 sufficiently to occupy that part of the injection chamber's volume that was not filled with fuel. The distance measured from this point to the point where downward injection plunger travel is completed is termed the "solid fuel height" and determines the point in the plunger's travel when injection actually begins.

Figure 5C:
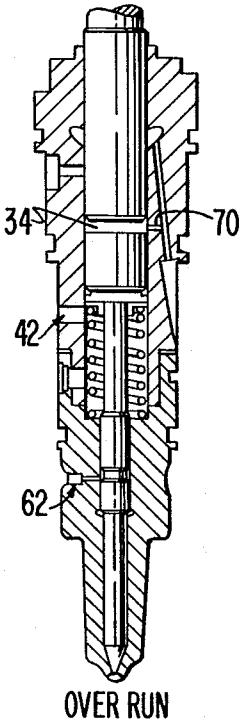

Injection continues with further downward movement of lower plunger 22 and ends sharply when the tip of lower plunger 22 contacts its seat in the nozzle tip as shown in FIG. 5*c*. During this third portion of the injector operation, the overrun stage, the hydraulic link between plunger 24 and 26 is collapsed. During this stage, upper plunger 26 continues to move downwardly to force the timing fluid out of timing chamber 34. The flow resistance created by valve spring 60 is chosen to ensure that the pressure developed in the collapsing timing chamber 34 between plungers 24 and 26 is sufficient to hold lower plunger 22 tightly against its seat to prevent secondary injection. Alternatively, as also shown in FIG. 5*c* and as will be described in further detail below, injector housing 16 may be formed with a timing fluid spillport 70, separate from timing chamber drain passage 38 and drainage passage 42, through which timing fluid drains at the end of the overrun stage.

Figure 5D:
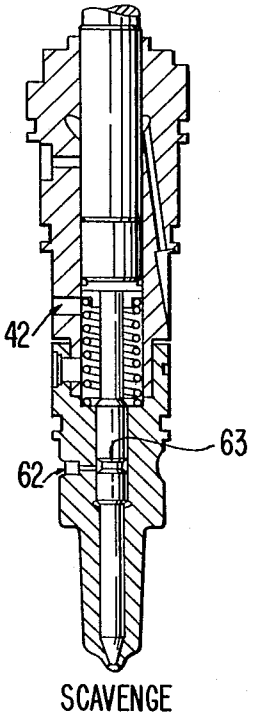

FIG. 5*d* shows the injector scavenge stage after all of the timing fluid has been drained so that plungers 24 and 26 no longer are separated. At this point, the entire injection train, from the injection cam to the nozzle tip, is in solid mechanical contact. In both the overrun and scavenge stages (FIGS. 5*c* and 5*d*), the system is scavenged of gases and the injector is cooled. In particular, when injection has ended by plunger 22 seating in the nozzle tip, fuel passes from fuel supply passage 62 to an axially relieved portion 63 of lower plunger 22 and travels upwardly into compensating chamber 32 (via a passage not shown) and then out of injector housing 16 via drainage passageway 42. Alternatively, as shown in FIGS. 1 and 2*a*, a separate scavenge flow drain port 68 may be used.

As explained above, as long as injection pressure remains less than a preset value determined by valve spring 60 and timing spring 56, injection continues normally until it is ended sharply by the seating of lower plunger 22 in the nozzle tip. At this point, the pressure in timing chamber 34 rises to a level sufficient to unseat valve element 44, thereby allowing the fuel to drain from timing chamber 34 through timing chamber draining passage 38, compensating chamber 32, and drainage passageway 42. Furthermore, valve mechanism 40 regulates the pressure of the hydraulic link in timing chamber 34 formed between plungers 24 and 26 to prevent uncontrolled collapse and secondary injection. On the other hand, if during the injection cycle the injection pressure exceeds the preset value as embodied in valve spring 60 while plunger 22 is still being driven toward the nozzle tip, the pressure in the timing chamber between plungers 24 and 26 will overcome the sealing pressure exerted by valve spring 60 and timing spring 56, thereby allowing fuel to escape from timing chamber 32 to drainage passageway 42 via timing chamber drain passage 38. In this case, valve mechanism 40 serves to regulate the pressure in the hydraulic link so that injection is completed at pressures which are close to the preset maximum. Thus, valve spring 60 controls the timing fluid pressure independently of timing spring 56, and control of the timing fluid pressure does not affect the setting of the injection timing. This pressure regulating action of valve mechanism 40 also ensures that the duration of injection is minimized and that injection ends sharply, without secondary injection.

Figure 4B:
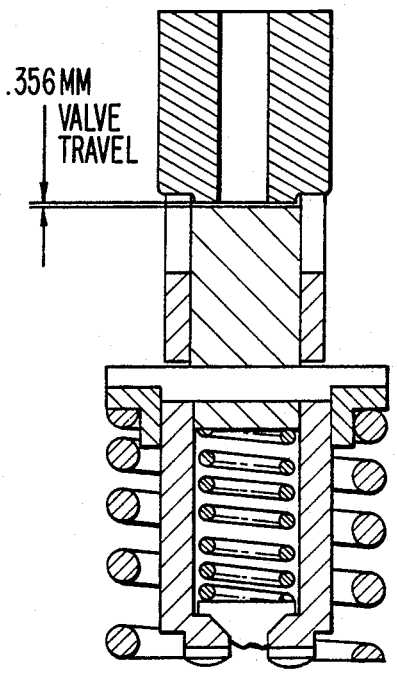

Referring again to FIGS. 3 and 4, two embodiments of valve mechanism 40 are shown. FIGS. 3*a* and 3*b* illustrate valve mechanism 40 in its closed and opened positions. When valve element 44 moves away from the opening of timing chamber draining passage 38 to permit drainage of timing fluid, valve element 44 preferably is less than 0.01 inch away from the passage. That is, the valve element moves less than 0.01 inch between its open and closed positions. Preferably this distance is approximately 0.008 inch. FIG. 4 illustrates an alternate embodiment for valve mechanism 40 shown in both the closed and open positions. In this embodiment, valve element 44 is lengthened as compared with the first embodiment. Although this increases the mass of the valve element the spring force of the valve spring can be similarly increased to compensate for the increased mass. Additionally, in this embodiment shorter timing spring and valve springs are used to prevent spring buckling. As shown in FIGS. 4*a* and 4*b*, valve body 44 travels 0.356 mm or approximately 0.01 inch between its closed and open positions.

Figure 6A:
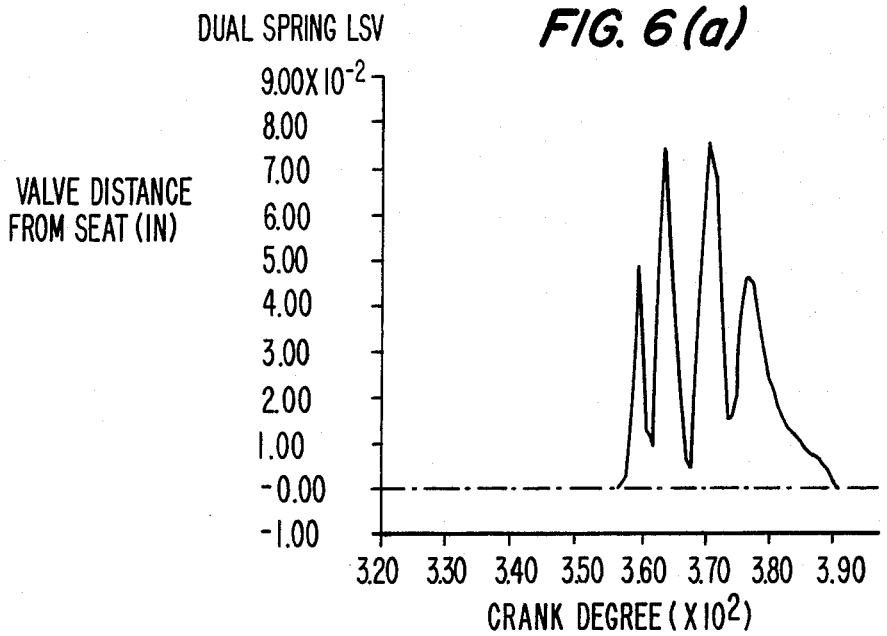
FIGS. 6*a* and 6*b* are graphs comparing the operation of the dual spring low speed valve with a prior art single spring low speed valve.
Figure 6B:
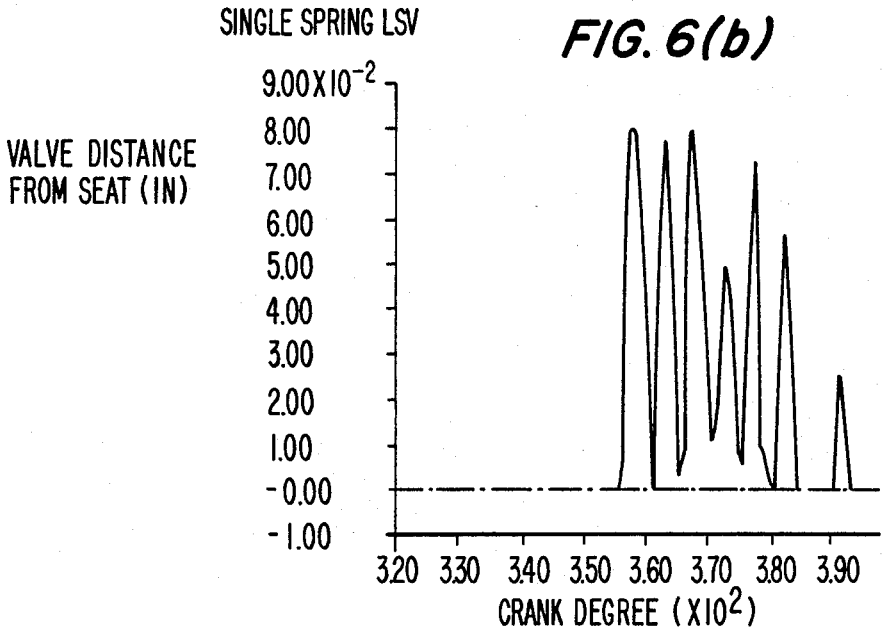

As compared with earlier attempts using single spring three hole valves and single spring single hole valves as described above and the single spring valves disclosed in the '247 patent, the dual spring low speed valve can achieve significantly higher flow areas. In the injector of FIGS. 6 and 7 of the '247 patent, the flow area of the valve seat formed by the passage adjacent the valve is approximately 1.5% of the coplanar cross-sectional area of the intermediate plunger. In the present invention, the area of the valve seat formed by passage 38 adjacent valve element 44 is approximately 4.4% of the coplanar cross-sectional area of intermediate plunger 24. Thus, the area of the passageway in the present invention is almost three times the area of the prior art passageways. The increased area is made possible by using two separate springs 56 and 60 and produces the numerous improvements and advantages achieved by the present invention.

The dual spring unit fuel injector of the present invention improves the pressure regulation by the valve and increases the flow area capability of the valve to eliminate the need in some circumstances for a spillport in the injector housing. The increased spring load achieved by the valve spring (from 12.1 lbs to 23.6 lbs in one embodiment) enables the cross-sectional flow area of the timing chamber drain passage (the valve seat area) to be increased while still maintaining the same valve opening pressure (because opening pressure equals spring load divided by timing chamber drain passage area). The timing chamber drain passage is large enough that the main restriction in the valve is the distance the valve body moves (the valve opening size) during opening of the valve mechanism, thereby improving the regulating capability. The combination of the mass of the valve mechanism combined with one third of the mass of the timing and valve springs is less than the mass of equivalent components in single spring type injectors. This decreases the inertia and provides a better and quicker valve response. This allows the valve mechanism to open and close more frequently during a given time period to act as a regulator rather than an orifice, and to decrease the possibility of secondary injection caused by a relatively slow valve response. Additionally, at rated speed (e.g., 5,000 rpm) and load, the number of large oscillations of the valve is decreased and the pressure regulation capabilities are increased over three-hole valve designs, as shown graphically in FIG. 6. The decrease in the number of valve oscillations improves the valve and spring durability because a single spring tends to fatigue and wear faster than a dual spring design. This valve design allows the spillport to be eliminated obtaining better performance than a three hole valve and spillport combination design.

Figure 7A:
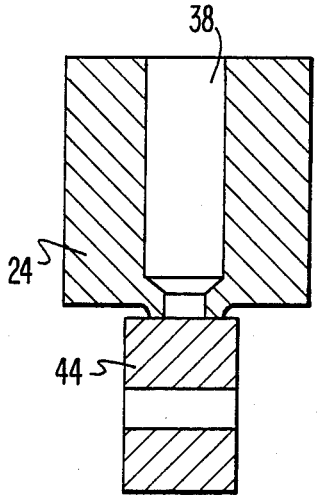
FIGS. 7*a* through 7*c* are three different embodiments of the drain passage which may be formed in the intermediate plunger of an injector designed in accordance with the subject invention.
Figure 7B:
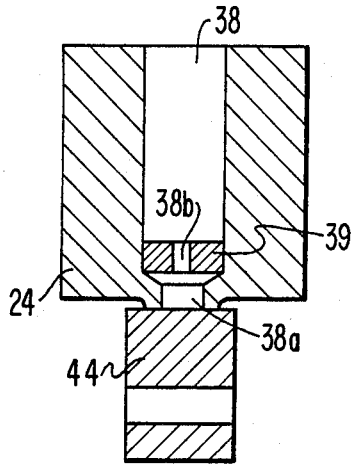
Figure 7C:
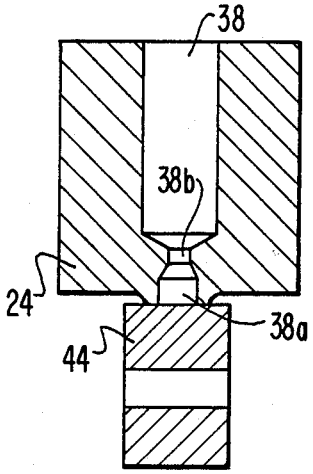

In the alternative embodiment shown in FIG. 7, the performance of the dual spring high pressure unit fuel injector is improved further by forming timing chamber drain passage 38 of at least two portions having different cross-sectional areas. The remainder of the fuel injector is as described above. FIG. 7*a* illustrates, for comparison, the drainage passage of the embodiments of FIGS. 1–5. FIGS. 7*b* and 7*c* are two different versions of the alternate embodiment having a multiple area drain passage 38. A main orifice is formed at the bottom of timing chamber drain passage 38 adjacent valve element 44. The main orifice or valve seat 38*a* has a cross-sectional area that is selected to control the opening operating pressure of valve mechanism 40, and therefore the pressure of timing fluid within the timing chamber 34. Valve seat 38*a* controls the valve opening for a given spring rate and preload. Thus, the size of valve seat 38*a* controls the injection pressure of the fuel injector. Regulating orifice 38*b* is formed upstream of valve seat 38*a* and has a cross-sectional area that is smaller than the cross-sectional area of valve seat 38*a*. Regulating orifice 38*b*, in combination with valve seat 38*a* and the valve opening distance, controls the flow rate of timing fluid through timing chamber drain passage 38 in intermediate plunger 24. In most instances, because the cross-sectional area of regulating orifice 38*b* is smaller than that of valve seat 38*a*, the flow rate is dominated by the size of regulating orifice 38*b* and the flow rate is less than otherwise permitted by the size of the valve seat. For a given size of valve seat 38*a*, the opening pressure of valve mechanism 40 remains the same. However, by using a smaller size regulating orifice 38*b*, the effective flow area is reduced and controlled by the regulating orifice. Thus, the injection pressure can be more easily regulated to achieve better injection characteristics. This provides for a smoother discharge flow and prevents an undesirably large discharge flow which could result in a large pressure drop before the valve mechanism closes. Furthermore, by restricting the flow rate, the exiting timing fluid pressure remains higher after the valve mechanism is open. This increased pressure and the lower flow rate prevent the hydraulic link from totally collapsing before the lower plunger 22 is seated at the bottom of the injection chamber 64 and maintains the lower plunger in its seated position to prevent secondary injection. The restriction imposed on the flow by regulating orifice 38*b* when combined with the inertia effect of valve element 44 creates high peak pressures which can be countered by using a lower spring load. The lower spring load improves the durability and increases the life of the system. Additionally, the improved pressure regulation accomplished with this design typically yields higher mean injection pressures, lower peak-to-peak values, and shorter injection duration. These benefits appear to increase with increasing operating speeds.

In the embodiment of FIG. 7*b*, regulating orifice housing 39 is formed as an insert portion disposed within timing chamber drain passage 38. For a drain passage 38 having a predetermined main orifice or valve seat cross-sectional area, any one of a plurality of different regulating orifice housings 39 may be used, each one having a regulating orifice 38*b* having a different cross-sectional area. Thus, for a given valve seat area, which solely determines the operating pressure of valve mechanism 40, a regulating orifice housing 39 having regulating orifice 38*b* may be selected so that the area of regulating orifice 38*b* creates the desired timing fluid discharge flow rate. In FIG. 7*c* an intermediate plunger 24 having a predetermined regulating orifice 38*b* area is shown. In either embodiment of FIGS. 7*b* and 7*c*, because the sizes of valve seat 38*a* and regulating orifice 38*b* differ, by varying these orifices, one of the operating pressure and the timing fluid discharge flow rate can be changed without altering the operating characteristics of the other.

Figure 8:
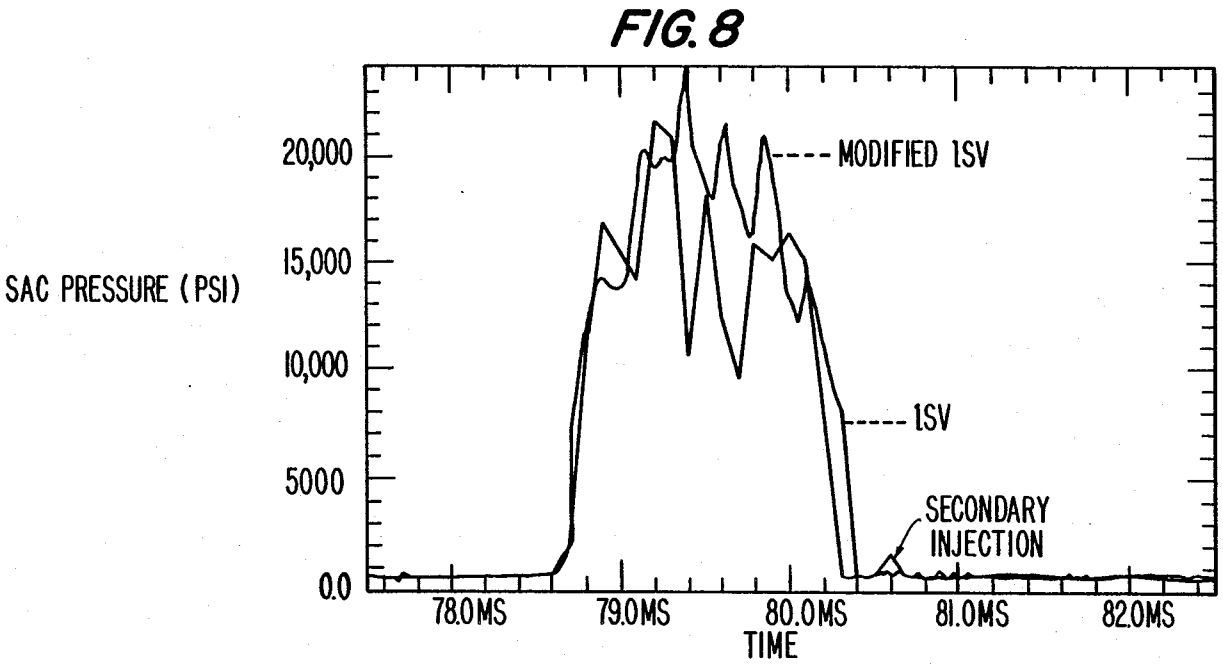
FIG. 8 is a graph comparing the sac pressures versus time of the valves of FIGS. 7*b* and 7*c* with the valve of FIGS. 1–5 at an operating speed of 3,000 rpm.
Figure 9:
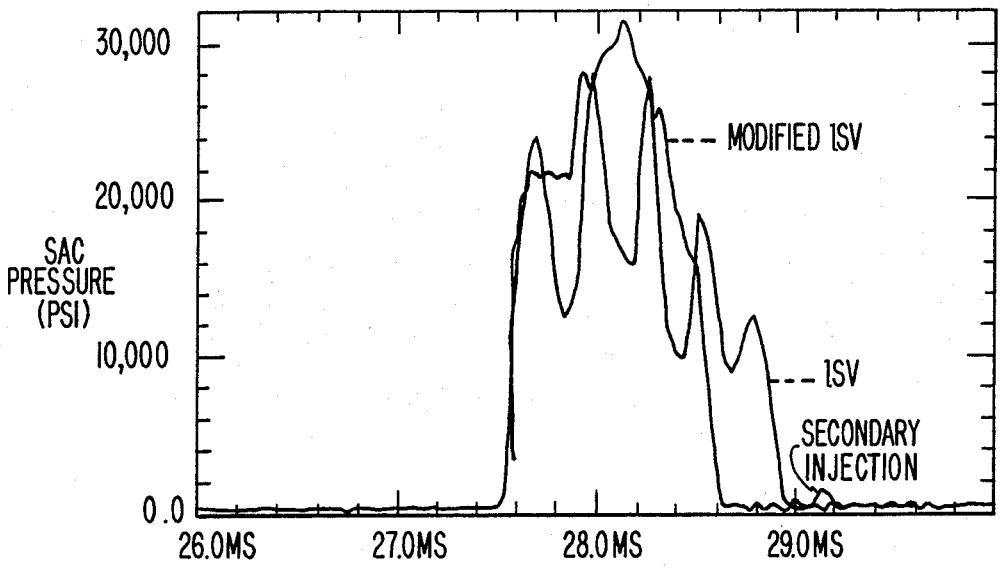
FIG. 9 is a graph comparing the sac pressures versus time of the valves of FIGS. 7*b* and 7*c* with the valve of FIGS. 1–5 at an operating speed of 4,200 rpm.
Figure 10:
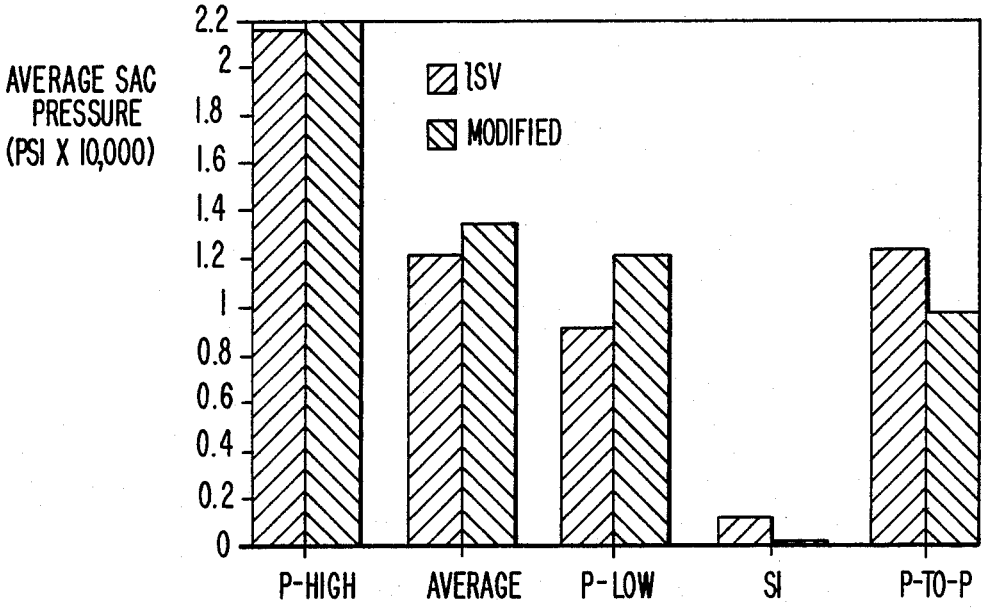
FIG. 10 is a graph comparing the highest, average, and lowest pressures, the amount of secondary injection, and the peak-to-peak difference for the valves compared in FIG. 8.
Figure 11:
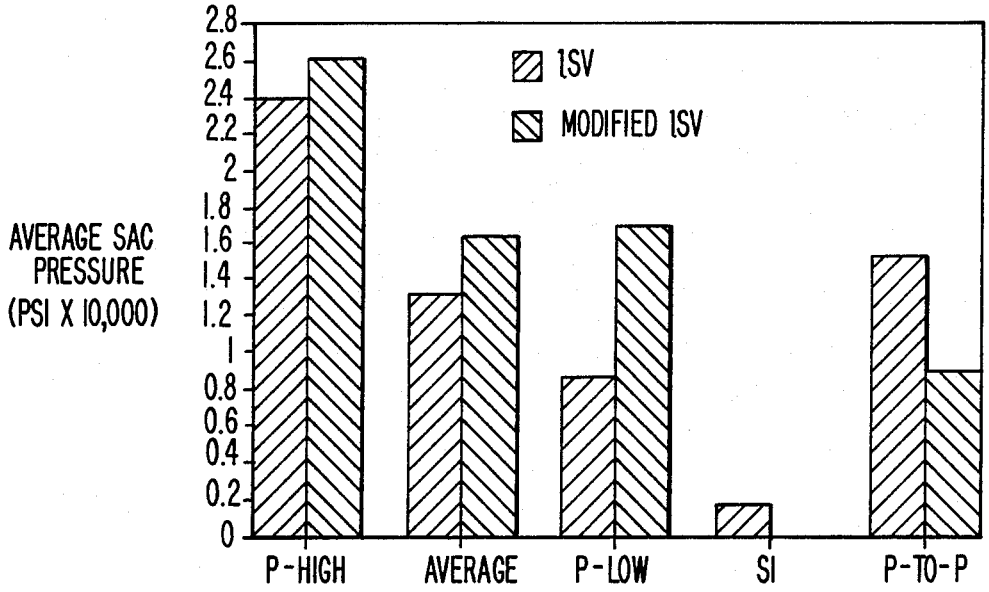
FIG. 11 is a graph comparing the highest, average, and lowest pressures, the amount of secondary injection, and the peak-to-peak difference for the valves compared in FIG. 9.
Figure 12:
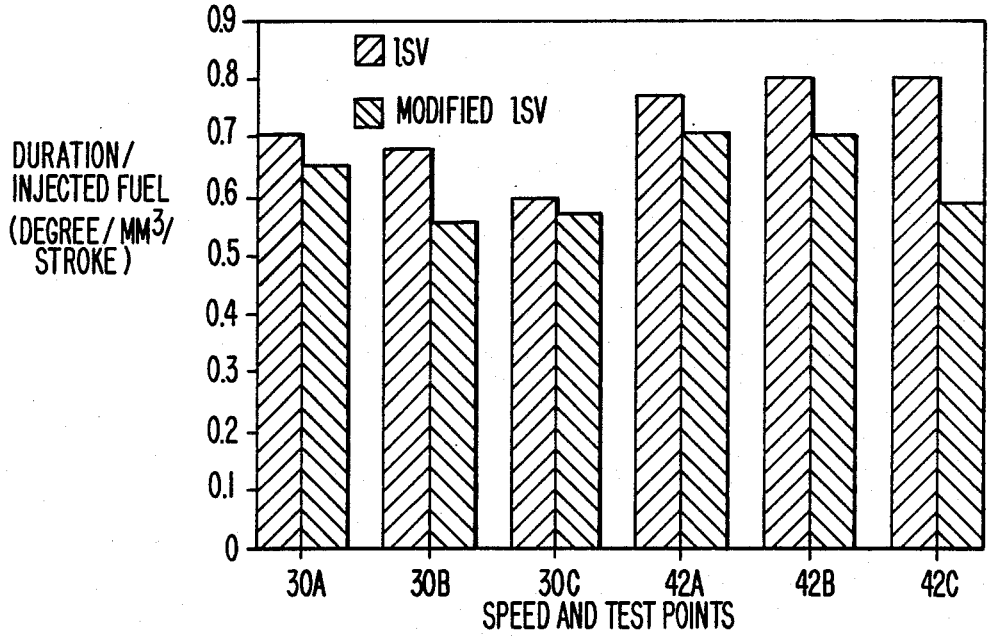
FIG. 12 is a graph comparing injection duration at various speeds and operating conditions of six test runs for the valves of FIGS. 7*b* and 7*c* and the valve of FIGS. 1–5.

As graphically illustrated in FIGS. 8–12, this multiple area orifice design achieves better pressure regulation, higher mean injection pressures, shorter injection duration, reduced spring stress, and the elimination of some secondary injections. FIGS. 8 and 9 compare the performance of the valve having the regulating orifice of FIGS. 7*b* and 7*c* with the dual spring valves of FIGS. 1–5 by comparing the attained sac pressures during injection at operating speeds of 3,000 rpm and 4,200 rpm. Note that secondary injection is reduced with the modified valve of FIGS. 7*b* and 7*c*. FIGS. 10 and 11 are bar graphs comparing various characteristics of the two types of valve systems as derived from the graphs of FIGS. 8 and 9. In particular, FIGS. 10 and 11 compare high, average, and low sac pressures, incidence of secondary injection, and differences between high peak and low peak sac pressures. FIG. 12 compares six test runs of the valve having the regulating orifice with a valve having no regulating orifice, three at 3000 rpm and three at 4200 rpm at three different operating conditions indicated as A, B, and C. Due to the difficulty in metering a precise predetermined quantity of fuel, the duration is determined for a given amount of fuel to render valid comparisons. As can be seen from these figures, the valve with the regulating orifice (FIGS. 7*b* and 7*c*) achieves larger high pressures, larger low pressures, and larger average pressures at both operating speeds, while significantly reducing occurrences of secondary injection and reducing the difference between the peak-to-peak (highest-to-lowest) pressures.

In an alternative use, it is envisioned that the timing fluid discharge passage having a main orifice or valve seat and a reduced area upstream regulating orifice may be used without the dual spring system for the valve mechanism. Furthermore, this timing fluid discharge orifice may be used with HPI fuel injectors without the valve disclosed herein (such as those of the '247 patent) as well as with other fuel systems using differently operating fuel injectors to control the injection pressure directly.

Figure 13:
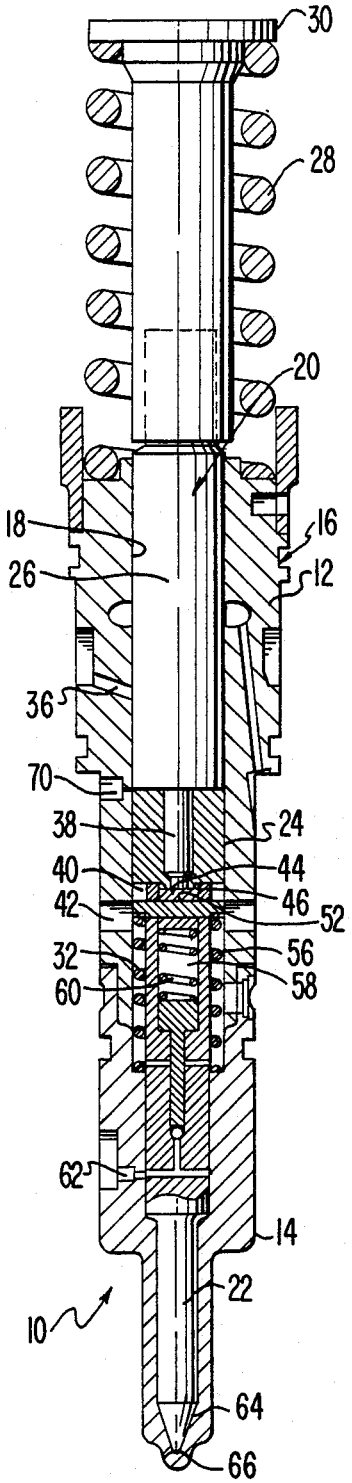
FIG. 13 is a cross-sectional view of a dual spring low speed valve high pressure unit fuel injector having a timing chamber spillport according to another embodiment of the present invention.

FIG. 13 illustrates an alternative embodiment of the fuel injector of the present invention in which two additional important features are shown. The first feature involves forming a timing chamber spillport 70 in barrel 12 of injector housing 16 in addition to valve mechanism 40 with its timing chamber drain passage 38 and drainage passageway 42. Although the use of valve mechanism 40 and its accompanying components obviates the need for a timing chamber spillport in some circumstances, it has been found that using a timing chamber spillport in conjunction with a valve in a high pressure unit fuel injector provides several unexpected advantages.

The spillport 70, as shown in FIG. 13 and also in FIG. 5*c*, is used to drain timing fluid from timing chamber 34 during the overrun stage of the injection cycle after the fuel has been injected into the engine cylinders. As described above with respect to FIG. 5*c*, overrun begins when injection ends by the tip of lower plunger 22 contacting its seat in the nozzle tip. Because upper plunger 26 continues to move downwardly, timing fluid is forced out of timing chamber 34 and the hydraulic link therein collapses. However, rather than draining the timing fluid past valve mechanism 40, the timing fluid drains through timing chamber spillport 70. In this way, timing chamber spillport 70 and the valve means controlled passage 38 independently control the drainage of timing fluid and the two fuel draining paths operate separately and at different times of the injection cycle. The valve mechanism operates to control pressure in the timing chamber by regulating and limiting peak timing fluid pressure during the second and the third stages, the injection and overrun stages, particularly at high speed and high load operating conditions, while the spillport controls collapse of the hydraulic link after injection during the overrun stage.

The presence and use of timing chamber spillport 70 decreases the use of valve mechanism 40 by over 50% as the valve mechanism will operate only when timing fluid pressure exceeds a preset limit and not during the overrun stage of each injection cycle. Thus, valve mechanism 40 would operate only during high load and middle to high speed conditions, because in other operating modes the timing fluid pressure typically does not approach the level set by the valve mechanism. This extends the life and improves the durability of valve mechanism 40 and particularly of valve spring 60 and the valve seat areas which are highly stressed. Additionally, the overall injection performance may be improved by this configuration because spillport induced hydraulic link collapse and valve induced hydraulic link collapse can be separately set and optimized. The spillport is sized to control collapse of the timing chamber after injection has ended and the valve mechanism is selected and set to limit peak injection pressures during injection. The flow area of the valve mechanism can be decreased significantly because it is sized only for pressure limiting and not timing fluid spill. This prevents a large pressure drop when the valve mechanism is initially opened to allow better control of the load during and after injection. Thus, valve mechanism 40 can operate over a much smaller pressure range which improves the quality of the valve regulation.

Moreover, by combining the spillport with the valve mechanism, operation of the fuel injector is observed to produce less noise at idle, low speed operating conditions, and at low load conditions for all speeds of operation. Furthermore, at the desired 60 $mm^3$/stroke injection rate, the combination of the valve mechanism with the spillport achieves higher cam velocities than the valve mechanism alone. At both low (1000 rpm) and high (5000 rpm) speeds the combination achieves higher peak sac pressures, and at both rated and high idle operating conditions the combination produces lower Hertz stresses. As shown, the timing chamber spillport has been combined with valves using a dual spring system in high pressure fuel injectors. However, the same advantages are obtainable by combining the timing chamber spillport with any type of valve. Even without the dual spring configuration or the dual orifice timing fluid discharge passage, using a spillport with a valve mechanism improves the pressure regulation capabilities of the valve mechanism and therefore the fuel injector.

The second modification of the high pressure unit fuel injector with timing chamber pressure control which is shown in FIG. 13 includes providing an improved closure formed on the lower portion of upper plunger 26 for timing chamber spillport 70. Upper plunger 26 is formed of a cylindrical sidewall 72 and a planar lower wall 74. Sidewall 72 intersects lower wall 74 at a generally sharp perpendicular angle in the vicinity of timing chamber spillport 70, and this perpendicular relationship may extend completely around upper plunger 26. Thus, sidewall 72 extends parallel to the inner walls of axial bore 18 all the way to lower wall 74. There is no beveled or chamfered portion. This is in contrast with known and currently used configurations as illustrated in FIG. 1, for example, in which the lowermost portion of sidewall 72 is beveled or chamfered as at dashed line 76. In these known fuel injectors without a timing fluid spillport closure as described herein, the spillport area is too large to maintain a sufficient load on the injection plunger to prevent secondary injections with a beveled upper plunger 26. This is because the beveled lower portion of sidewall 72 does not reduce the area of or close the spillport to maintain sufficient pressure to hold lower plunger 22 tightly on its seat. As shown in FIG. 13, which illustrates the end of injection stage of operation similar to that of FIG. 5*c* in which timing chamber 34 is being collapsed, camshaft velocity and upper plunger velocity are very low, and the lower wall 74 of upper plunger 26 is nearing direct mechanical contact with the upper wall of intermediate plunger 24. The nonbeveled portion of sidewall 72 serves to close timing chamber spillport 70 at least partially but possibly completely. This decreases the effective area of timing chamber spillport 70 at the end of injection notwithstanding the decreasing plunger speed to maintain a relatively high pressure in the timing chamber which, in turn, maintains a sufficiently high spill load on lower plunger 22 to prevent lower plunger 22 from rising off of its seat in injection chamber 64 and causing secondary injection. Additionally, the closure of spillport 70 in this manner has been found to increase power and reduce unburned hydrocarbon emissions in the engine.

Figure 14:
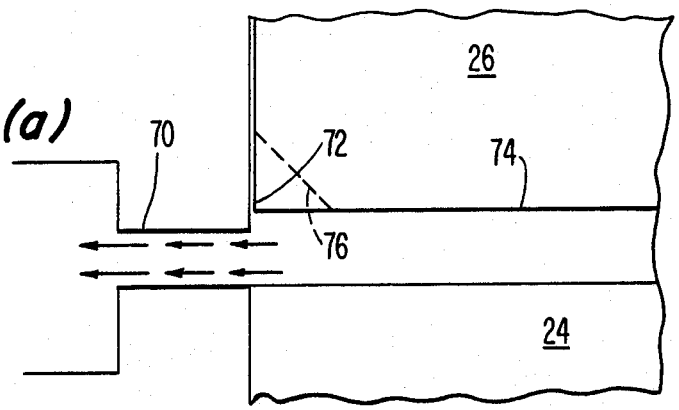
FIGS. 14*a*, 14*b*, and 14*c* are enlarged cross-sectional views of the timing chamber spillport closure of FIG. 13 showing the various stages of spillport closure.
Figure 14:
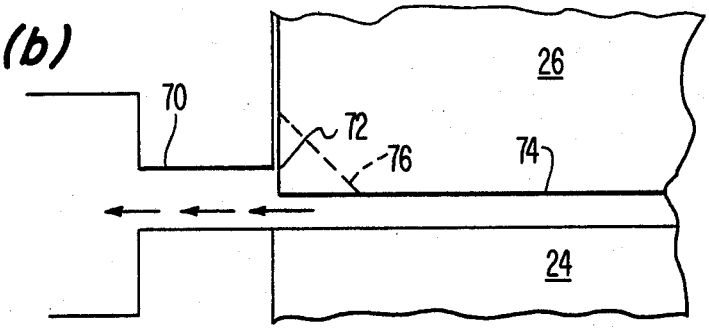
Figure 14:
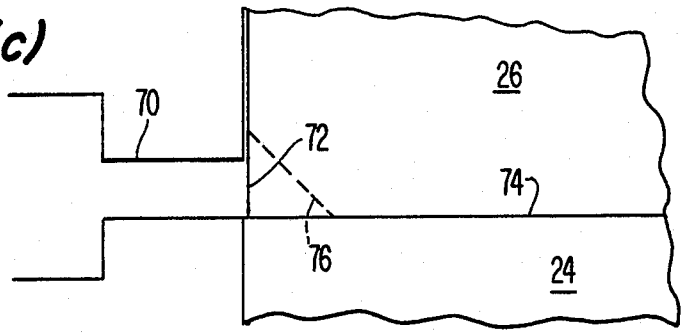

As more clearly shown in FIGS. 14*a*, 14*b*, and 14*c*, the closure of spillport 70 is shown in three stages. In the first stage, FIG. 14*a*, the spillport is completely open. In the second stage, FIG. 14*b*, upper plunger 26 partially closes spillport 70, and the spillport is completely closed in the third stage, FIG. 14*c*. A bevel or chamfer 76, characteristic of prior art upper plungers is shown in broken line. The arrows depict the drainage of timing fluid.

In prior fuel injectors the bevel is formed to eliminate flow restrictions during the metering of timing fluid into the timing chamber. According to this invention, the use of a non-beveled upper plunger 26 also eliminates these flow restrictions by either using a larger timing fluid metering port, opening the metering port further, or forming an undercut or internal barrel groove in the barrel at the location of the metering port. All of these solutions prevent flow restrictions during filling while maintaining high spill loads to prevent secondary injections during spilling. The preferred solution is to increase the size of the metering port and to open the metering port further.

Figures 15, 15A, 15B, 15C:
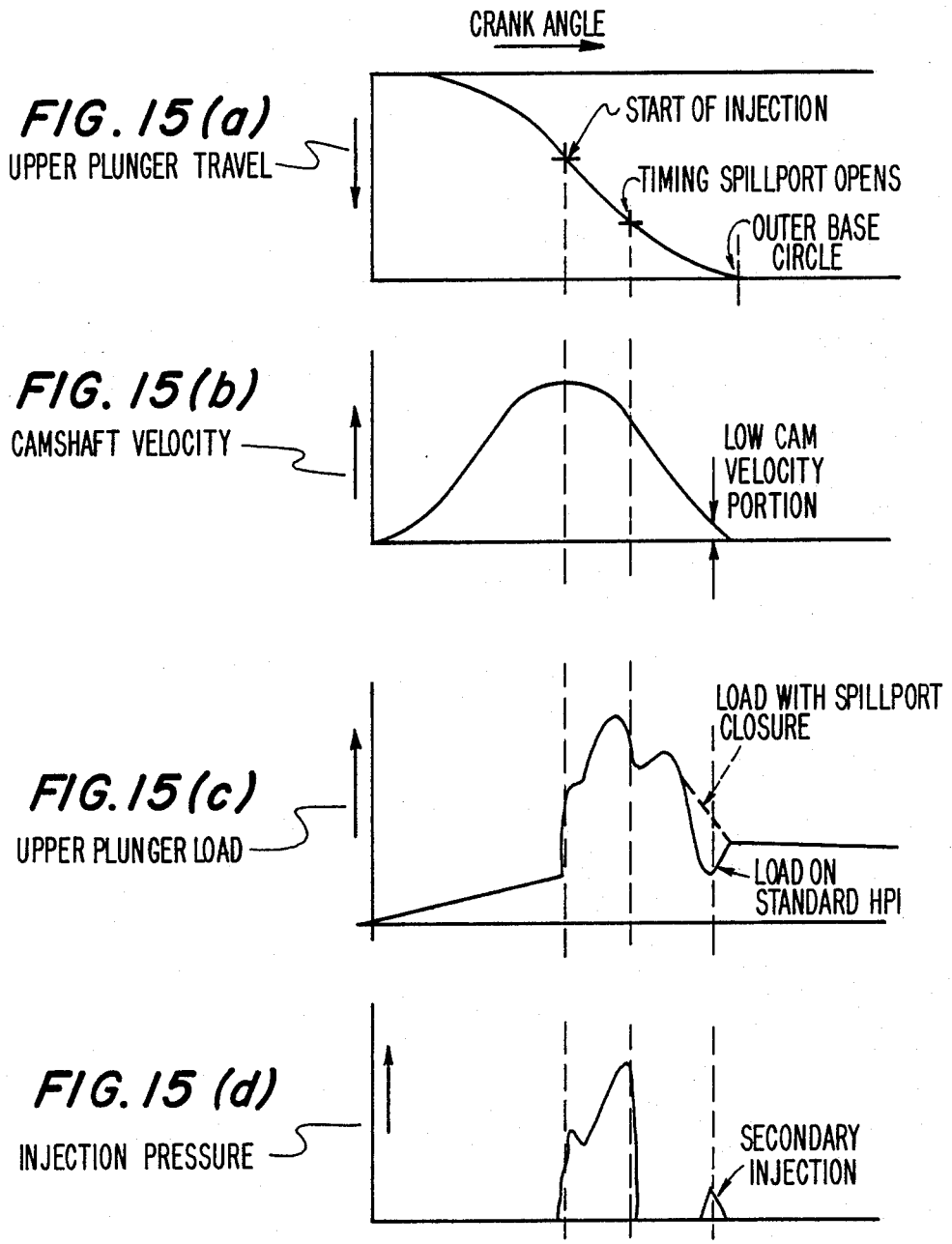

FIG. 15 is a series of four graphs, plotting the upper plunger travel, the camshaft velocity, the upper plunger load, and the injection pressure versus crank angle. Corresponding crank angles on each graph are so indicated. In the graph of FIG. 15*a*, the upper plunger travel is shown. In FIG. 15*b* cam velocity is shown. The standard HPI unit fuel injector has a relatively low load on the upper plunger near the end of injection as shown by the dip identified as "load on standard HPI" illustrated in FIG. 15*c*. As shown in FIG. 15*d*, this low permits the injection or lower plunger to rise off of its seat and create secondary injection. In contrast, using the spillport closure on the upper plunger of the present invention increases the upper plunger load as compared with known high pressure injector loads as shown in broken line in FIG. 15*c*. This produces a sharper, cleaner end of injection without high crush loads as are produced in prior art injectors and eliminates secondary injections common to prior injectors as shown in FIG. 15*d*. This is also accomplished without the use of a lost motion mechanism which complicates the fuel injector and which creates an overtravel distance as required in FIG. 3 of the '137 patent noted above. Additionally, this timing spillport closure is not limited to high pressure fuel injectors using low speed valves but may be used with any fuel injector having a timing chamber spillport.

Thus, the high pressure unit fuel injector according to the present invention provides improved pressure regulation with increased fluid flow capabilities in the valve. Because two separate springs are used with the valve mechanism, the timing can be optimized simultaneously with and separately from setting the required operating pressure of the valve mechanism. The increased flow capabilities therefore can be achieved while maintaining the valve opening pressure. The use of two springs also improves the durability of the valve mechanism and the injector as a whole by spreading the spring loads over two springs to reduce spring fatigue. These advantages are significant improvements over prior single spring systems in which one spring was used to both control the valve pressure and control timing by biasing the lower plunger. Moreover, the valve opening pressure and the discharge flow rate can be controlled separately by varying the area of the draining passage in the intermediate plunger to further improve and optimize operation of the fuel injector. Finally, a timing chamber spillport may be provided to drain timing fluid after injection and to supplement the valve and improve operation of the valve, and an improved closure for the timing chamber spillport may be used to prevent secondary injections.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

INDUSTRIAL APPLICABILITY

The high pressure unit fuel injector of the present invention finds application in a large variety of internal combustion engines. One particularly important application is for small compression ignition engines adopted for automotive uses such as powering automobiles. Lighter truck engines and medium range horsepower engines also could benefit from the use of fuel injectors according to the present invention.

We claim:

1. A high pressure unit fuel injector for injecting fuel into the combustion chamber of an internal combustion engine comprising:
   - an injector housing having a central bore and an injection orifice located at the lower end of said injector housing and communicating between said central bore and the combustion chamber;
   - upper and lower plungers mounted for reciprocating movement within said central bore;
   - hydraulic timing means for varying the timing of the injection of metered fuel, said hydraulic timing means including an intermediate plunger mounted for reciprocating movement within said central bore between said upper plunger and said lower plunger to form a collapsible timing chamber disposed between said upper plunger and said intermediate plunger;
   - a drain passage for draining timing fluid from said timing fluid chamber;
   - valve means movable from a closed position to an open position to limit the pressure of timing fluid in said timing chamber by releasing timing fluid from said timing chamber through said passage;
   - first biasing means for biasing upwardly said lower plunger into engagement with said intermediate plunger to establish a biasing force which limits the metering of timing fluid into said timing chamber and which tends to move said valve means toward its closed position; and
   - second biasing means for adding additional biasing force which tends to move said valve means toward its closed position without increasing the biasing force which resists metering of timing fluid into said timing chamber.

2. The fuel injector according to claim 1 further comprising motion limiting means for limiting the movement of said valve means toward its closed position induced by said second biasing means.

3. The fuel injector according to claim 2 wherein said first and second biasing means each comprises a coil spring, said first biasing means is disposed around said lower plunger, and said second biasing means is disposed within a hollow portion in an upper end of said lower plunger.

4. The fuel injector according to claim 3 wherein said passage is contained in said intermediate plunger and communicates with said timing chamber and the portion of said central bore below said intermediate plunger, and said valve means comprises a valve element having an upper surface sealingly disposed across the lower opening of said passage when said valve means is in its closed position.

5. The fuel injector according to claim 4 wherein said hollow portion in said upper end of said lower plunger is formed as a valve guide and said valve element is translatably received within said valve guide, and wherein said second biasing means provides a directly upwardly biasing force on the lower surface of said valve element.

6. The fuel injector according to claim 5 wherein said valve guide is formed with aligned radial openings adjacent said valve guide, and wherein said valve element includes a pin affixed to said valve element and extending in opposite directions into said openings, respectively, to define the limits of movement of said valve element relative to said lower plunger.

7. The fuel injector according to claim 6, wherein the distance through which said valve element moves between its open and closed positions is approximately 0.01 inch.

8. The fuel injector according to claim 1 wherein said valve means is formed having a low mass to limit inertia effects on the movement of said valve means and to increase the response time of said valve means.

9. The fuel injector according to claim 1 wherein said passage is disposed through said intermediate plunger to form a seat for said valve means on the lower surface of said intermediate plunger, wherein the flow area of said valve seat is at least four percent of the coplanar cross-sectional area of said intermediate plunger.

10. The fuel injector according to claim 1 wherein said passage includes a valve seat disposed adjacent said valve means, said valve seat defining an effective cross-sectional area on said valve element subjected to the pressure of the fluid in said timing chamber when said valve element is closed, said passage further including a regulating orifice positioned upstream of said valve seat, said regulating orifice having an effective cross-sectional area which is smaller than the effective cross-sectional area of said valve seat whereby said valve seat controls the opening pressure of said valve means, and said regulating orifice controls the rate of discharge flow of the timing fluid.

11. The fuel injector according to claim 1 further comprising a timing chamber spillport formed in said injector housing for draining timing fluid from said timing fluid chamber, said timing chamber spillport being positioned to be opened only as said lower plunger nears its lowest position at which said injection orifice is closed, said timing chamber spillport having sufficient flow rate capabilities to cause timing fluid to drain from said timing chamber primarily through said spillport rather than through said valve means when said upper plunger nears its lowest position.

12. The fuel injector according to claim 11 wherein said timing chamber spillport is sized to restrict discharge of timing fluid from said timing chamber upon said lower plunger reaching its lowest position to maintain sufficient pressure on said lower plunger to tend to hold said lower plunger in its lowest position.

13. The fuel injector according to claim 11 wherein said upper plunger comprises a cylindrical sidewall and a generally planar lower surface, wherein said cylindrical sidewall intersects said lower surface at a generally sharp perpendicular angle such that said timing chamber spillport is gradually restricted by said cylindrical sidewall of said upper plunger as said upper plunger nears its lowest position and said timing chamber nears its substantially fully collapsed condition.

14. The fuel injector according to claim 13 wherein the lower portion of said cylindrical sidewall is shaped to at least partially close said timing chamber spillport as said upper plunger nears its lowest position and the velocity of said upper plunger is decreasing whereby the effective area of said timing chamber spillport is reduced to maintain high fluid pressure in said timing chamber which, in turn, maintains high downward pressure on said lower plunger to prevent secondary injection.

15. The fuel injector according to claim 14 wherein said passage includes a valve seat disposed adjacent said valve means, said valve seat defining an effective cross-sectional area on said valve element subjected to the pressure of the fluid in said timing chamber when said valve element is closed, said passage further including a regulating orifice positioned upstream of said valve seat, said regulating orifice having an effective cross-sectional area which is smaller than the effective cross-sectional area of said valve seat, whereby said valve seat controls the opening pressure of said valve means and said regulating orifice controls the rate of discharge flow of the timing fluid.

16. A high pressure unit fuel injector for injecting fuel into the combustion chamber of an internal combustion engine comprising:

an injector housing having a central bore and an injection orifice located at the lower end of said injector housing and communicating between said central bore and the combustion chamber;

upper and lower plungers mounted for reciprocating movement within said central bore;

hydraulic timing means for varying the timing of the injection of metered fuel, said hydraulic timing means including an intermediate plunger mounted for reciprocating movement within said central bore between said upper plunger and said lower plunger to form a collapsible timing chamber disposed between said upper plunger and said intermediate plunger;

a drain passage for draining timing fluid from said timing fluid chamber;

valve means movable from a closed position to an open position to limit the pressure of timing fluid in said timing chamber by releasing timing fluid from said timing chamber through said drain passage;

biasing means for acting on said valve means to control the valve opening pressure of said valve means; wherein said passage includes a valve seat disposed adjacent said valve means, said valve seat defining an effective cross-sectional area on said valve element subjected to the pressure of the fluid in said timing chamber when said valve element is closed, said passage further including a regulating orifice positioned upstream of said valve seat, said regulating orifice having an effective cross-sectional area which is smaller than the effective cross-sectional area of said valve seat, whereby said valve seat controls the opening pressure of said valve means and said regulating orifice controls the rate of discharge flow of timing fluid.

17. The fuel injector according to claim 16 further comprising a timing chamber spillport formed in said injector housing for draining timing fluid from said timing fluid chamber, said timing chamber spillport being positioned to be opened only when said lower plunger reaches its lowest position at which said injection orifice is closed, said timing chamber spillport having sufficient flow rate capabilities to cause timing fluid to drain from said timing chamber primarily through said spillport rather than through said valve means when said upper plunger nears its lowest position.

18. The fuel injector according to claim 17 wherein said timing chamber spillport is sized to restrict discharge of timing fluid from said timing chamber upon said lower plunger nearing its lowest position to maintain sufficient pressure on said lower plunger to tend to hold said lower plunger in its lowest position.

19. The fuel injector according to claim 17 wherein said upper plunger comprises a cylindrical sidewall and a generally planar lower surface, wherein said cylindrical sidewall intersects said lower surface at a generally sharp perpendicular angle such that said timing chamber spillport is gradually restricted by said cylindrical sidewall of said upper plunger as said upper plunger nears its lowest position and said timing chamber nears its substantially fully collapsed condition.

20. The fuel injector according to claim 19 wherein the lower portion of said cylindrical sidewall is shaped to at least partially close said timing chamber spillport as said upper plunger nears its lowest position and the velocity of said upper plunger is decreasing whereby the effective area of said timing chamber spillport is reduced to maintain high fluid pressure in said timing chamber which, in turn, maintains high downward pressure on said lower plunger to prevent secondary injection.

21. A high pressure unit fuel injector for injecting fuel into the combustion chamber of an internal combustion engine comprising:

an injector housing having a central bore and an injection orifice located at the lower end of said injector housing and communicating between said central bore and the combustion chamber;

upper and lower plungers mounted for reciprocating movement within said central bore;

hydraulic timing means for varying the timing of the injection of metered fuel, said hydraulic timing means including an intermediate plunger mounted for reciprocating movement within said central bore between said upper plunger and said lower plunger to form a collapsible timing chamber disposed between said upper plunger and said intermediate plunger for receiving timing fluid and forming a collapsible hydraulic link;

a passage for draining timing fluid from said timing fluid chamber;

valve means for opening and closing said passage;

biasing means for acting on said valve means to control the valve opening pressure of said valve means; and a timing chamber spillport formed in said injector housing for draining timing fluid from said timing fluid chamber, said timing chamber spillport being positioned to be opened only when said lower plunger nears its lowest position at which said injection orifice is closed, said timing chamber spillport having sufficient flow rate capabilities to cause timing fluid to drain from said timing chamber primarily through said spillport rather than through said valve means when said upper plunger nears its lowest position.

22. The fuel injector according to claim 21 wherein said timing chamber spillport is sized to restrict discharge of timing fluid from said timing chamber upon said lower plunger nearing its lowest position to maintain sufficient pressure on said lower plunger to tend to hold said lower plunger in its lowest position.

23. The fuel injector according to claim 21 wherein said upper plunger comprises a cylindrical sidewall and a generally planar lower surface, wherein said cylindrical sidewall intersects said lower surface at a generally sharp perpendicular angle such that said timing chamber spillport is gradually restricted by said cylindrical sidewall of said upper plunger as said upper plunger nears its lowest position and said timing chamber nears its substantially fully collapsed condition.

24. The fuel injector according to claim 21 wherein the lower portion of said cylindrical sidewall is shaped to at least partially close said timing chamber spillport as said upper plunger nears its lowest position and the velocity of said upper plunger is decreasing whereby the effective area of said timing chamber spillport is reduced to maintain high fluid pressure in said timing chamber which, in turn, maintains high downward pressure on said lower plunger to prevent secondary injection.

25. A unit fuel injector for injecting fuel into the combustion chamber of an internal combustion engine comprising:

an injector housing having a central bore and an injection orifice located at the lower end of said injector housing and communicating between said central bore and the combustion chamber;

a lower plunger mounted for reciprocating movement within said central bore;

an upper plunger mounted for reciprocating movement within said central bore, wherein said upper plunger comprises a cylindrical sidewall and a generally planar lower surface, wherein said cylindrical sidewall intersects said lower surface at a generally sharp perpendicular angle;

hydraulic timing means for varying the timing of the injection of metered fuel, said hydraulic timing means including an intermediate plunger mounted for reciprocating movement within said central bore to form a collapsible timing chamber disposed between said upper plunger and said intermediate plunger;

a passage for draining timing fluid from said timing fluid chamber; and a timing chamber spillport formed in said injector housing for draining timing fluid from said timing fluid chamber, wherein said timing chamber spillport is gradually restricted by said cylindrical sidewall of said upper plunger as said lower plunger nears its lowest position and said timing chamber nears its substantially fully collapsed condition.

26. The fuel injector according to claim 25 wherein the lower portion of said cylindrical sidewall is shaped to at least partially close said timing chamber spillport as said upper plunger nears its lowest position and the velocity of said upper plunger is decreasing whereby the effective area of said timing chamber spillport is reduced to maintain high fluid pressure in said timing chamber which, in turn, maintains high downward pressure on said lower plunger to prevent secondary injection.

27. A high pressure unit fuel injector for injecting fuel into the combustion chamber of an internal combustion engine comprising:

an injector housing having a central bore and an injection orifice located at the lower end of said injector housing and communicating between said central bore and the combustion chamber;

upper and lower plungers mounted for reciprocating movement within said central bore;

hydraulic timing means for varying the timing of the injection of metered fuel, said hydraulic timing means comprising a collapsible timing chamber formed between said upper and lower plungers;

valve means movable from a closed position to an open position to limit the pressure of timing fluid in said timing chamber during fuel injection by releasing timing fluid from said timing chamber;

first biasing means for biasing upwardly said lower plunger during metering of timing fluid into said timing chamber to establish a biasing force which limits the metering of timing fluid into said timing chamber and which tends to move said valve means toward its closed position; and second biasing means for adding additional biasing force which tends to move said valve means toward its closed position without increasing the biasing force which resists metering of timing fluid into said timing chamber.

* * * * *